US010307003B2

(12) United States Patent
Green et al.

(10) Patent No.: US 10,307,003 B2
(45) Date of Patent: Jun. 4, 2019

(54) AERODYNAMICALLY STABILIZED FOOD PLATE

(71) Applicants: Connor Joseph Green, Lexington, MA (US); Jack Palmer Green, Lexington, MA (US)

(72) Inventors: Connor Joseph Green, Lexington, MA (US); Jack Palmer Green, Lexington, MA (US)

( * ) Notice: Subject to any disclaimer, the term of this patent is extended or adjusted under 35 U.S.C. 154(b) by 70 days.

(21) Appl. No.: 15/281,421

(22) Filed: Sep. 30, 2016

(65) Prior Publication Data

US 2018/0092476 A1 Apr. 5, 2018

(51) Int. Cl.

| | |
|---|---|
| ***B65D 1/34*** | (2006.01) |
| ***A47G 19/02*** | (2006.01) |
| ***A47G 19/03*** | (2006.01) |
| ***A47G 19/06*** | (2006.01) |
| ***A47G 23/06*** | (2006.01) |

(52) U.S. Cl.

CPC ..... *A47G 19/02* (2013.01); *A47G 19/03* (2013.01); *A47G 23/06* (2013.01); *B65D 1/34* (2013.01); *A47G 19/06* (2013.01)

(58) Field of Classification Search

CPC ..... A47G 19/02; A47G 19/03; A47G 19/06; A47G 23/06; B65D 1/34; A01K 5/00; A01K 5/0114; A01K 5/0121

USPC ..... 220/574; D7/505, 557, 550.1; 119/61.5; 131/240.1

See application file for complete search history.

(56) References Cited

U.S. PATENT DOCUMENTS

| | | | | |
|---|---|---|---|---|
| 2,053,949 | A * | 9/1936 | Emery | B65D 1/34 220/574 |
| 2,826,346 | A | 3/1958 | Randall | |
| 3,430,803 | A | 3/1969 | Nelson | |
| 5,593,062 | A * | 1/1997 | Martin | A47G 19/065 220/556 |
| 6,561,375 | B1 * | 5/2003 | Nagy | A47G 19/02 206/460 |
| 9,326,625 | B1 * | 5/2016 | Esfahani | A47G 19/02 |
| 2003/0098310 | A1 * | 5/2003 | McGee | A01K 5/0114 220/574.3 |
| 2005/0056690 | A1 | 3/2005 | Clapper | |
| 2014/0239000 | A1 * | 8/2014 | Evans | A47G 19/065 220/575 |

* cited by examiner

*Primary Examiner* — Fenn C Mathew
*Assistant Examiner* — Jennifer Castriotta
(74) *Attorney, Agent, or Firm* — Anthony M. Del Zoppo, III; Daugherty & Del Zoppo Co. LPA

(57) ABSTRACT

A plate comprises a planar central region with a perimeter and a lip with first and second sections, each including two ends. A first end of the first section extends from the perimeter up and away from the planar central region, and a first of the second section extends from a second of the two ends of the first section down and away from the planar central region. A plate comprises circular, mid and end regions. The mid-region protrudes from an outer edge of the circular region in a first direction away therefrom. The end-region protrudes from an outer edge of the mid-region in an opposite direction and away therefrom. The mid and end-regions include openings. A plate comprises a first area and a rim surrounding the first area. The rim has walls which intersect. Each of the walls is either straight or concave. Both of the walls includes openings.

20 Claims, 7 Drawing Sheets

AERODYNAMICALLY STABILIZED FOOD PLATE

TECHNICAL FIELD

The following generally relates to a plate and more particularly to a plate configured to support food such as a picnic, dinner, etc. plate, including a wind resistant, aerodynamically stable plate.

BACKGROUND

FIG. 1 illustrates a top down view 100 of a prior art plate 102. FIG. 2 illustrates a cross-sectional view 200 of the plate 102 along line A-A of FIG. 1. In FIG. 2, the plate 102 rests on a surface 202 such as a table. With reference to FIGS. 1 and 2, the plate 102 includes a circular planar surface 104 having a radius 106. The planar surface 104 has a top side 108 which is configured to support a food product, and a bottom side 110 which is configured to rest on the surface 202. The top and bottom sides 108 and 110 are on opposite sides of the plate 102.

The plate 102 further includes a lip 112. The lip 112 includes a first convex section 114 protruding up and outward from the top side 108 of the planar surface 104 in a direction away from the planar surface 104 and having a first length 116. The lip 112 further includes a second convex section 118 extending from a free end of the first section 114 and having a second length 120. The second section 118 slopes downward and away from the planar surface 104. In other examples, the second convex section 118 extends parallel to the planar surface 104 or is omitted.

FIG. 3 illustrates a cross-sectional view 300 of the plate 102 along line B-B of FIG. 1 in connection with wind 302. In this example, the wind 302 flows towards the plate 102 with laminar flow. In FIG. 4, a first component 402 of the wind 302 strikes the second convex section 118 of the lip 112, exerting a first force (F1), which has both a horizontal component ($F1_h$) and a downward vertical component ($F1_v$). A second component 404 of the wind 302 traversing over the lip 112 causes pressure reduction above the lip 112, which results in a second force or upward vertical force ($F2_v$) on the lip 112.

A third component 406 of the wind 302 strikes the inside of the first convex section 114 under the lip 112, exerting a third force (F3), which has both a horizontal component ($F3_h$) and an upward vertical component ($F3_v$). The third component 406 of the wind 302, unlike the first and second components 402 and 404, is trapped under the lip 112, which increases a pressure under the lip 112, causing a fourth force or upward vertical force ($F4_v$). A fifth force includes a static or frictional force ($F_s$) between the bottom 110 of the plate 102 and the surface 202.

If the sum of the upward vertical forces is greater than the sum of the downward vertical forces, the plate 102 will lift off the surface 103. Furthermore, if the sum of the horizontal forces is greater than the static force, the plate 102 will slide across the surface 103 in the direction of the wind 302. As such, the plate 102 may only slide or only lift, or the plate 102 may concurrently slide and lift, depending on the forces. Unfortunately, such forces may result in plate 102 "flying" away and/or inadvertent expulsion of any food that was supported on the plate 102, e.g., due to the plate tipping, flipping, sliding, etc.

SUMMARY

Aspects of the application address the above matters, and others.

In one aspect, a plate for supporting a food product comprises a planar central region with a perimeter and a lip.

The lip includes a first section with two ends. A first of the two ends of the first section extends from the perimeter up and away from the planar central region. The lip further includes a second section with two ends. A first of the two ends of the second section extends from a second of the two ends of the first section down and away from the planar central region.

In another aspect, a picnic plate comprises a circular region configured to support a food product. The picnic plate further comprises a mid-region protruding from an outer edge of the circular region in a first direction away from the circular region, wherein the mid-region includes a plurality of openings. The picnic plate further comprises an end-region protruding from an outer edge of the mid-region in a second direction, which is opposite the first direction and away from the circular region, wherein the end-region includes the plurality of openings, and both of the walls includes openings.

In another aspect, a plate comprises a first area and a rim surrounding the first area, wherein the rim has opposing walls which intersect, and each of the walls is either straight or concave, and both of the walls includes openings Those skilled in the art will recognize still other aspects of the present application upon reading and understanding the attached description.

BRIEF DESCRIPTION OF THE DRAWINGS

The application is illustrated by way of example and not limitation in the figures of the accompanying drawings, in which like references indicate similar elements and in which.

DETAILED DESCRIPTION

Figure 5:
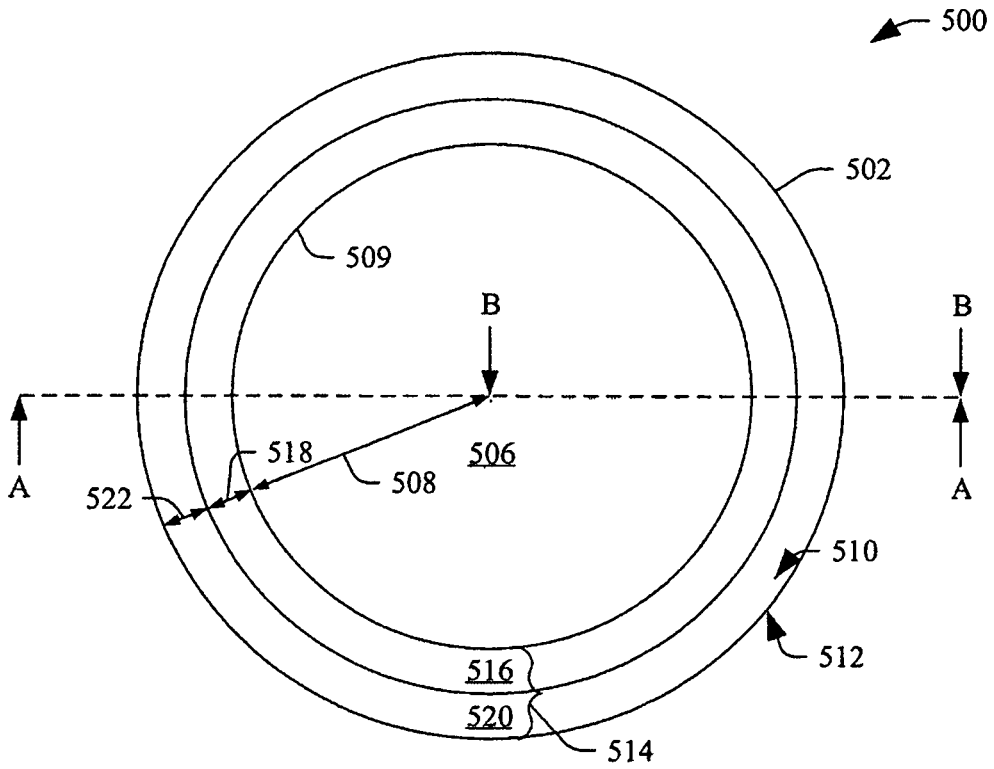
FIG. 5 schematically illustrates a top down view of an example food plate with a first shaped lip.
Figure 6:
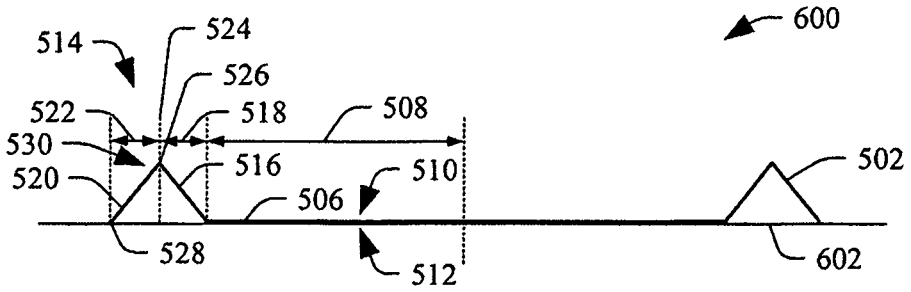
FIG. 6 schematically illustrates a cross-sectional view of the food plate of FIG. 5.

FIG. 5 illustrates a top down view 500 of an example plate 502, and FIG. 6 illustrates a cross-sectional view 600 of the plate 502 along line A-A of FIG. 5.

The plate 502 comprises Styrofoam®, plastic, paper pulp, cardboard, and/or other known material. The plate 502 is configured to support at least food and can be used outdoors (e.g., for picnics, barbeques, parties, etc.) and/or indoors. In either of these instances, the plate 502 is susceptible to receive wind. For example, at an outdoor picnic, the plate 502 is susceptible to receive wind whether resting on a table, the ground, a chair, a person's lap, etc. In another example, the plate 502 may be susceptible to receive wind from an open window, a fan, a breeze created from someone walking by, etc.

The illustrated plate 502 is circular. In another embodiment, the plate 502 is elliptical, square, rectangular, irregular and/or other shape. The plate 502 includes a generally planar surface 506 with a radius 508 and a perimeter 509. In another embodiment, the surface 506 is concave, convex, sloped, irregular, etc. Furthermore, the illustrated planar surface 506 is configured as a single compartment. In another embodiment, the planar surface 506 is divided up into two or more compartments, e.g., separated by ridges, walls, protrusions, etc. The planar surface 506 has a first or top side 510 which is configured to support a food product, etc., and a second or bottom side 512 which is configured to rest on the surface 602. The first and second sides 510 and 512 are on opposite sides of the plate 502.

The plate 502 further includes a rim or lip 514. The lip 514 includes a first linear section (or mid-region, wall, etc.) 516 with a length 518 and protruding up and outward from the first side 510 of the planar surface 506 in a direction away from the planar surface 506. The first linear section 516 surrounds the planar surface 506. The lip 514 further includes a second linear section 520 (or end-region, wall, etc.) with a length 522 and extending from the first section 516. The second section 520 slopes downward and away from the planar surface 506. The second section 520 surrounds the first linear section 516. The first and second linear sections 516 and 520 are symmetric about a line 524 bisecting an intersection 526 of the first and second linear sections 516 and 520, forming a carrot or inverse "v" shape ("A") with an apex 530.

A leading outer edge 528 of the second linear section 520 is in the plane of (co-planar with) the opposing side 512 of the planar surface 506 and rests on a surface 602 along with the opposing side 512 of the planar surface 506. With this configuration, generally, there is little to no gap between the leading outer edge 528 and the surface 602. This reduces or mitigates wind from entering under the lip 514 and exerting forces therein and creating pressures therein. In a variation, the leading outer edge 528 of the second linear section 520 is not in the plane of the opposing side 512 of the planar surface 506, but in a different plane, and either rests on the surface 602 (e.g., 522>518) or does not rest on the surface 602 (e.g., 522<518).

Figure 7:
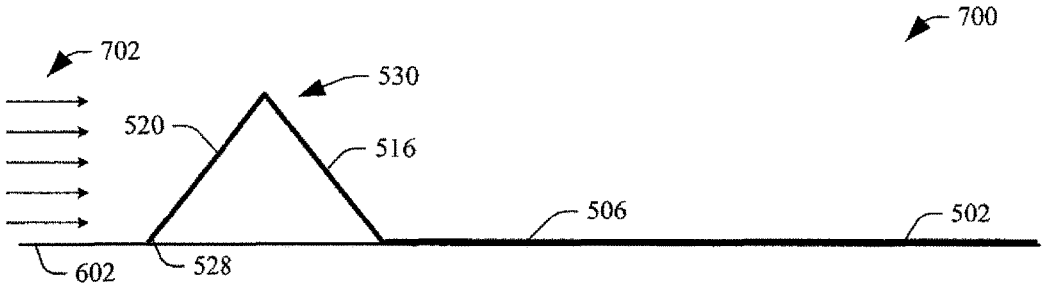
FIG. 7 schematically illustrates another cross-sectional view of the food plate of FIG. 5 in connection with laminar flowing wind.
Figure 8:
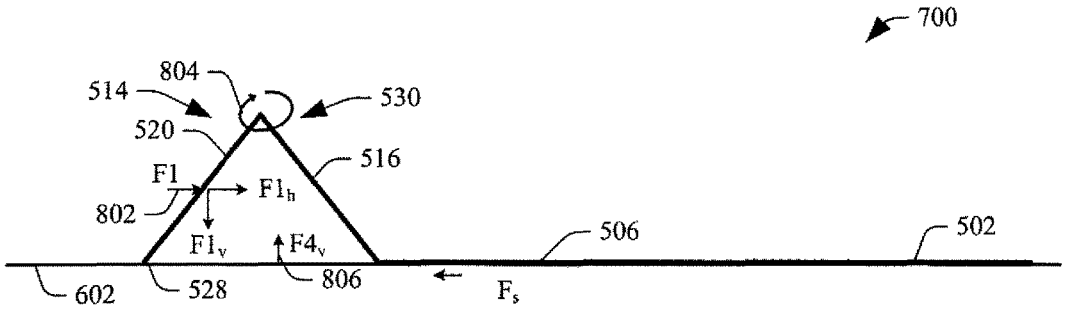
FIG. 8 schematically illustrates effects of the wind on the food plate of FIG. 5.

FIG. 7 illustrates a cross-sectional view 700 of the plate 502 along a line B-B of FIG. 6 in connection with wind 702. In this example, the wind 702 is laminar flowing wind that flows towards the plate 502. In FIG. 8, a first component 802 of the wind 702 strikes the second linear section 520 on the upward linear slope, exerting a force (F1), which has both a horizontal component ($F1_h$) and a downward vertical component ($F1_v$). Wind traversing the apex 530 results in turbulent flow 804. The turbulent flow 804 breaks or disrupts the upward vertical lift force created by laminar flow over the apex 530.

With this embodiment, the configuration of the lip 514 described herein reduces overall upward vertical lift forces. For example, the carrot shaped apex 530 reduces the upward vertical lift force above the lip 514, e.g., it breaks smooth laminar flow to minimize wind induced lift from air travelling over the top. This allows the plate 502 to maintain its location on the surface 602 and not lift from the surface 602 under wind conditions which would otherwise lift a plate, such as the plate 102, which did not produce the turbulent flow 804 to reduce the upward vertical lift force above the lip 514. In addition, the leading edge 528 touching the surface 602 further reduces upward vertical forces ($F4_v$) 806 under the lip 514 due to pressure build up.

Figure 9:
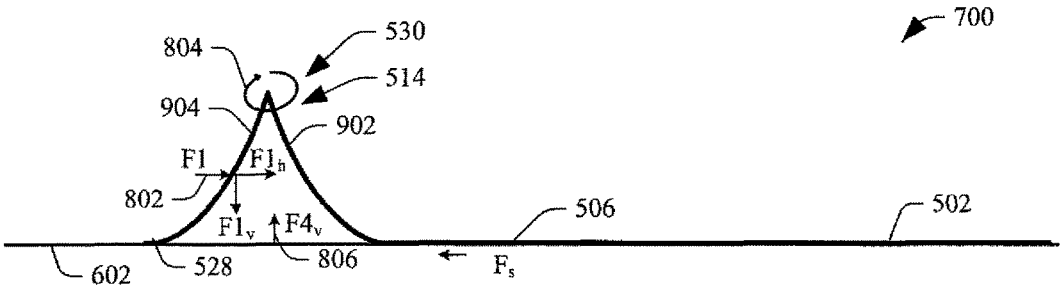
FIG. 9 schematically illustrates effects of wind on another example food plate.

FIG. 9 illustrates a variation of the plate 502 in FIG. 8 in which the first and second linear sections 516 and 520 are first and second concave sections 902 and 904. Similar to FIG. 8, the configuration of the lip 514 reduces upward vertical lift forces at least at the apex 530 and, where the leading edge 528 extends to the surface 602 (as shown) also under the lip 514.

With respect to FIGS. 5-9, generally, the outermost sections (516, 520, 902, 904) of the plate 502 are structurally configured to improve stability of the plate 5020 in windy conditions. Where the outermost downward sloping section extends such that it is co-planar with the planar surface 506, the plate 502 maximizes downward vertical wind induced forces on the plate 502 while at the same time blocking wind from the outermost upward sloping section, which reduces what would have been an upward vertical force component. The outermost sections can be either linear and/or concave, which minimizes laminar flow of wind across the top surface further reducing the lift effect of air traveling over the top of the surface.

Figure 10:
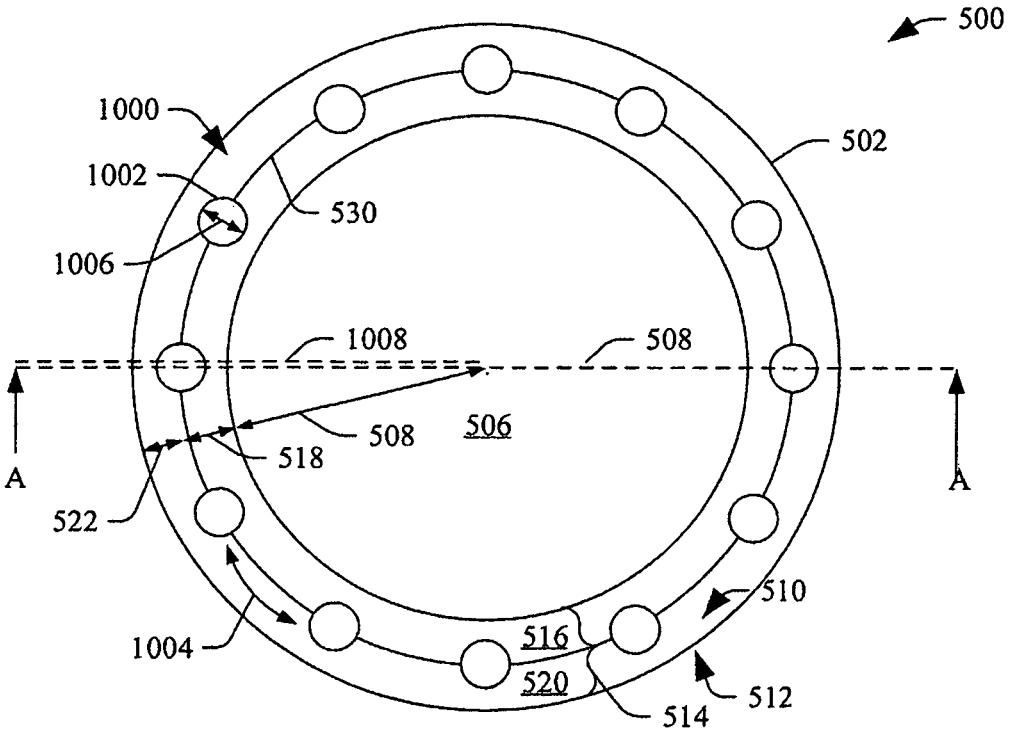
FIG. 10 schematically illustrates a top down view of yet another example food plate with a lip with material free regions.

FIG. 10 illustrates a variation of the configuration of the plate 502 in FIG. 5 in which parts 1000 of the first and second linear sections 516 and 520 of the lip 514 include a plurality of material free regions 1002 (e.g., holes, openings, etc.). In the illustrated embodiment, the plurality of material free regions 1002 are located about the apex 530, extend down at least a sub-portion of each of the first and second linear sections 516 and 520, and are separated by regions 1004 of the first and second linear sections 516 and 520.

The illustrated plurality of material free regions 1002 are circular and have a same diameter 1006. In a variation, at least two of the plurality of material free regions 1002 have a different diameter. In another variation, at least one of the plurality of material free regions 1002 is otherwise shaped, such as elliptical, square, rectangular, etc. The number of the plurality of material free regions 1002 in the illustrated embodiment is not limiting, and other embodiments can have more or less material free regions 1002.

Figure 11:
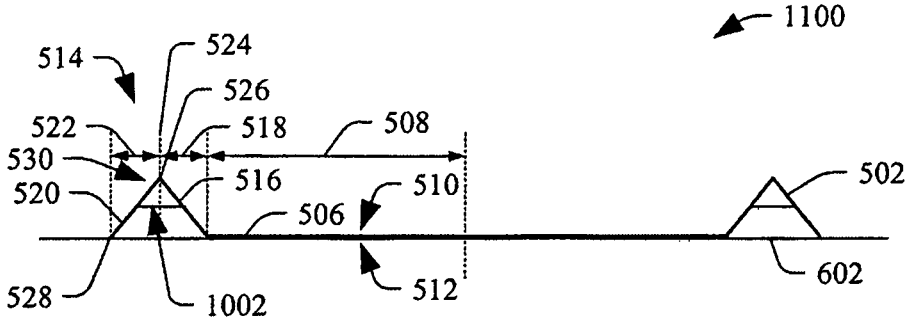
FIG. 11 schematically illustrates a cross-sectional view of the food plate of FIG. 10.
Figure 12:
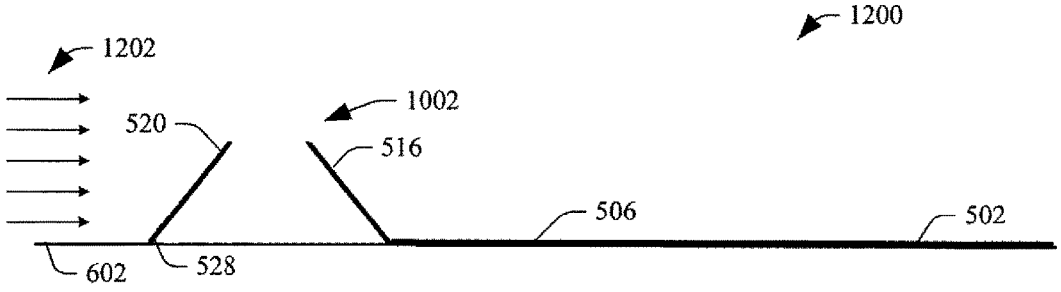
FIG. 12 schematically illustrates another cross-sectional view of the food plate of FIG. 10 in connection with laminar flowing wind.

FIG. 11 illustrates a cross-sectional view 1100 of the plate 502 along line A-A of FIG. 10. FIG. 11 is substantially similar to FIG. 6 except that FIG. 11 further shows material free regions 1002 in front of the apexes 530. FIG. 12 illustrates a cross-sectional view 1200 of a region 1008 (FIG. 10) of the plate 502 in connection with laminar flowing wind 1202.

Figure 1:
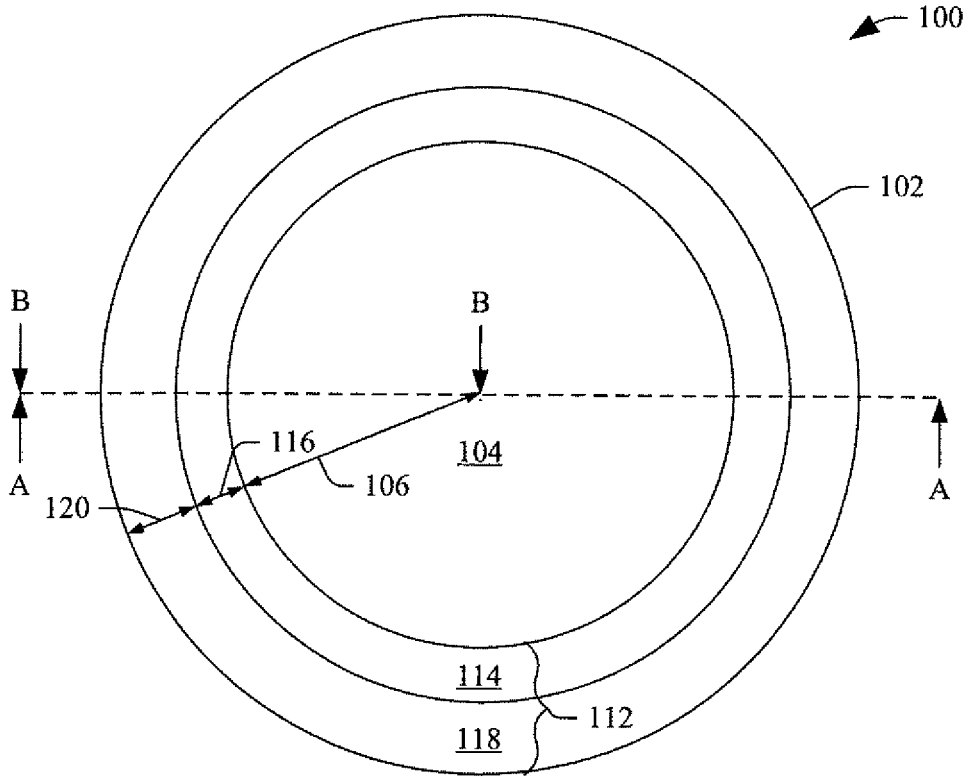
FIGURE 1 (PRIOR ART)
FIG. 1 schematically illustrates a top down view of a prior art food plate.
Figure 2:
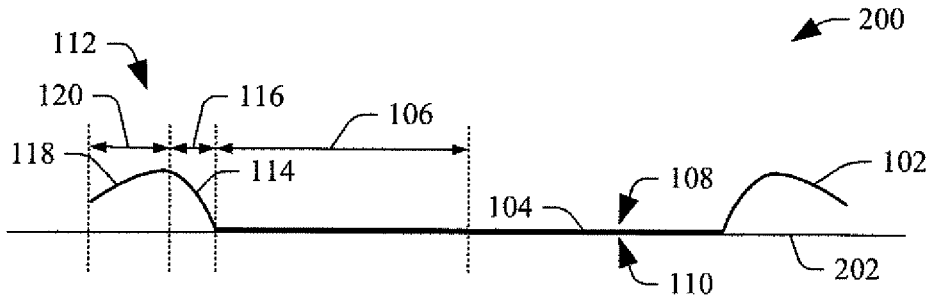
FIGURE 2 (PRIOR ART)
FIG. 2 schematically illustrates a cross-sectional view of the prior art food plate of FIG. 1.
Figure 3:
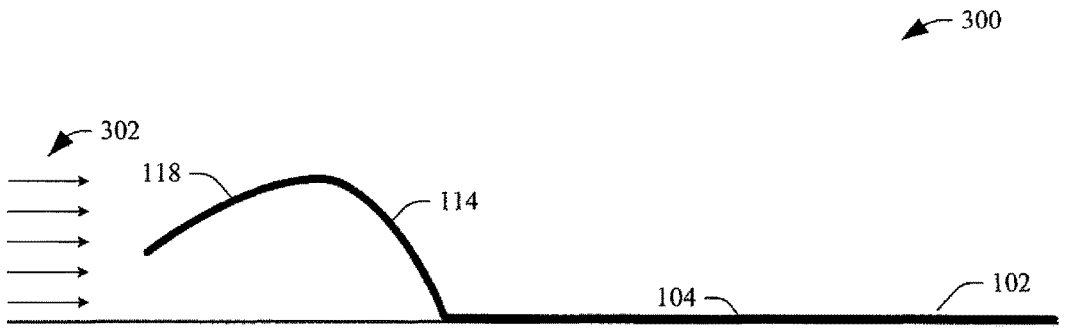
FIGURE 3 (PRIOR ART)
FIG. 3 schematically illustrates another cross-sectional view of the prior art food plate of FIG. 1 in connection with laminar flowing wind.
Figure 4:
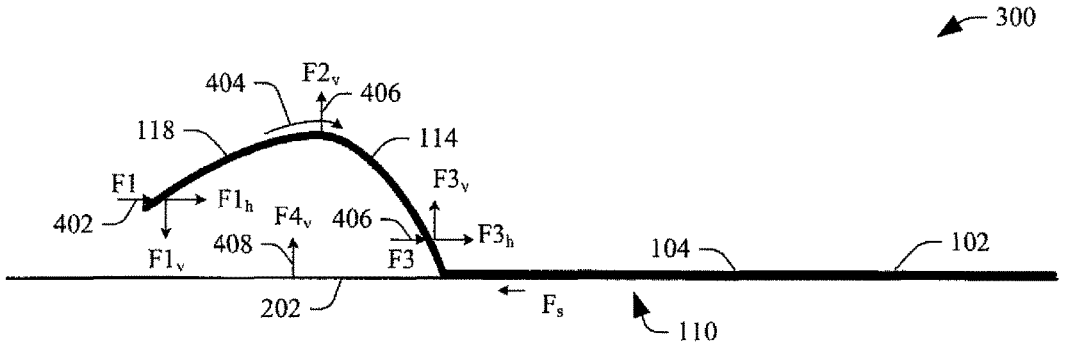
FIGURE 4 (PRIOR ART)
FIG. 4 schematically illustrates effects of the wind on the prior art food plate of FIG. 1.
Figure 13:
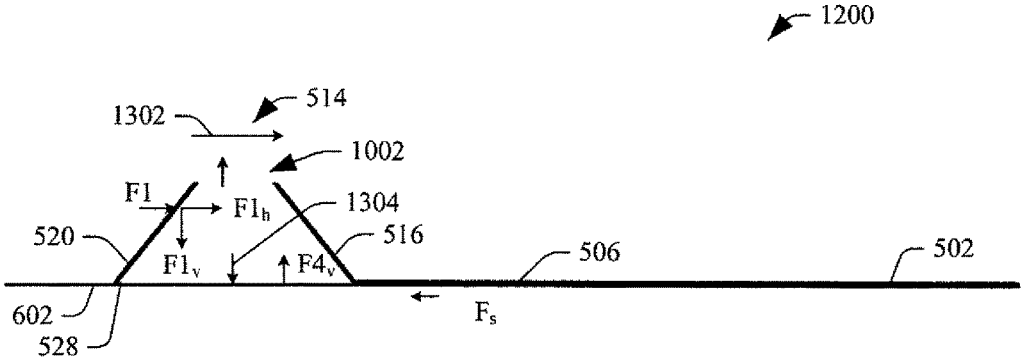
FIG. 13 schematically illustrates effects of the wind on the food plate of FIG. 10.
Figure 15:
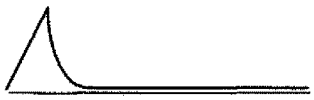
FIGS. 15-32 show a non-limiting set of combinations of the configurations described herein.
Figure 16:
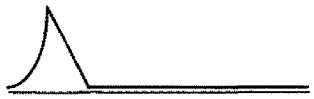
Figure 17:
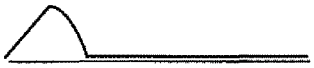
Figure 18:
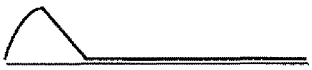
Figure 19:
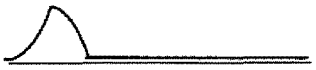
Figure 20:
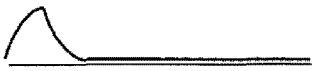
Figure 21:
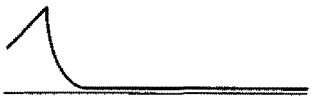
Figure 22:
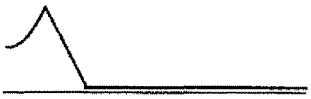
Figure 23:
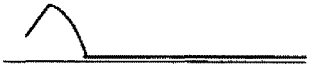
Figure 24:
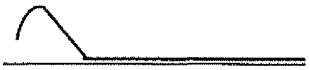
Figure 25:
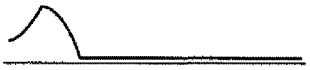
Figure 26:
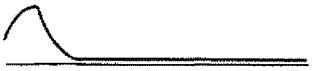
Figure 27:
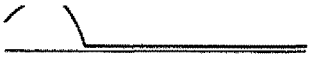
Figure 28:
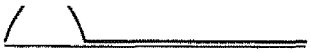
Figure 29:
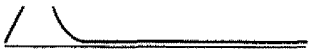
Figure 30:
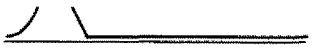
Figure 31:
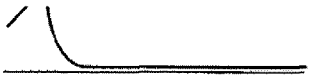
Figure 32:
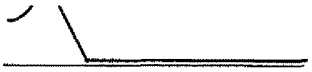

In FIG. 13, a wind component 1302 over the material free region 1002 changes a pressure over the lip 514, and the pressure gradient between the region over the lip 514 and the region under the lip 514 causes air in the cavity under the lip 514 to egress out of the material free region 1002. This reduces the pressure under the lip 514, which creates an additional downward vertical force 1304, which counteracts upwards vertical forces 408 (FIG. 4) and 806 (FIGS. 8 and 9) created due to the pressure. FIG. 15 shows a variation of the configuration of FIG. 13 in which the lip 514 includes the concave sections 902 and 904 described in FIG. 9.

Figure 14:
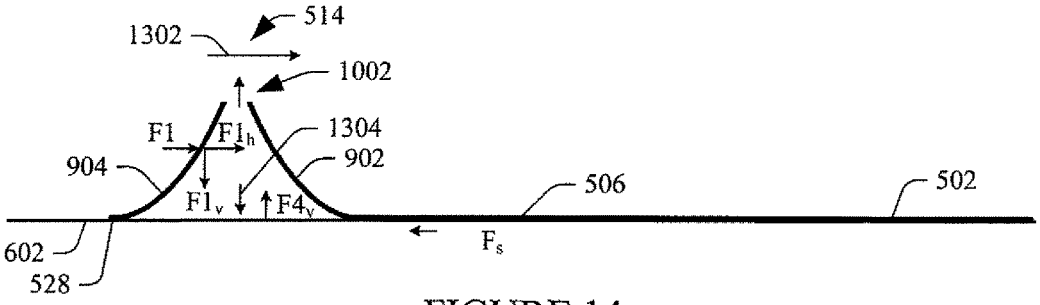
FIG. 14 schematically illustrates effects of the wind on a variation of the food plate of FIG. 10.

The configuration of the lip 514 in FIGS. 13 and 14 further reduces overall upward vertical lift forces. Again, this allows the plate 502 to maintain its location on the surface 602 and not lift from the surface 602 under wind conditions which would otherwise lift a plate, such as the plate 102, which does not include the material free regions 1002 through which air is drawn out from under the lip 514 to create an additional downward vertical lift force under the lip 514.

FIGS. 15-32 show a non-limiting set of combinations of the configurations described herein. This includes combinations with at least one side which is linear or concave, with or without the leading edge being co-planar with the surface 506, these combinations with the material free regions 1002, and prior art implementations improved non-obviously with the material free regions 1002. This set does not cover all possible permutations, and the skilled artisan would understand, based on the description herein, other configurations.

The application has been described with reference to various embodiments. Modifications and alterations will occur to others upon reading the application. It is intended that the invention be construed as including all such modifications and alterations, including insofar as they come within the scope of the appended claims and the equivalents thereof.

What is claimed is:

1. A plate for supporting a food product, comprising:
a planar central region with a perimeter, a top side, and a bottom side, which opposes the top side; and
a lip extending from the perimeter up from the top side, wherein the lip includes:
a first section with two ends, wherein a first of the two ends of the first section connects to the perimeter of the planar central region and an entirety of a region between the first of the two ends of the first section and a second of the two ends of the first section curves inward from the top side at the perimeter to the second end of the first section, up and away from the planar central region; and
a second section with two ends, wherein a first of the two ends of the second section connects to the second end of the first section and an entirety of a region between the first of the two ends of the second section and a second of the two ends of the second section curves inward from the second end of the first section to the second end of the second section, down and away from the planar central region,
wherein the entirety of the region of the first section and the entirety of the region of the second section curve inward towards each other.

2. The plate of claim 1, further comprising:
a plurality of holes about an apex at an intersection of the first section and the second section, wherein each of the plurality of holes extend down at least a sub-portion of each of the first and second sections, and the plurality of holes are separated from each other by material of the first and second sections.

3. The plate of claim 1, further comprising:
a material free region in both the first section and the second section of the lip, wherein the material free region is, in part, below an apex at an intersection of the first section and the second section and above part of a cavity formed below the lip.

4. The plate of claim 1, wherein the second of the two ends of the second section is co-planar with the planar central region.

5. The plate of claim 1, wherein the first and second sections are symmetric about an apex at an intersection of the first section and the second section.

6. The plate of claim 1, wherein the first section has a first length, the second section has a second length, and the first length and the second length are different lengths.

7. The plate of claim 6, wherein the first length is greater than the second length.

8. The plate of claim 6, wherein the second length is greater than the first length.

9. A plate for supporting a food product, comprising:
a planar central region with a perimeter, a top side, and a bottom side, which opposes the top side; and
a lip extending up from the top side, wherein the lip includes:
a first section with two ends, wherein a first of the two ends of the first section connects to the perimeter of the planar central region and an entirety of a region between the first of the two ends of the first section and a second of the two ends of the first section curves inward with an increasing slope from the top side at the perimeter to the second end of the first section, up and away from the planar central region; and
a second section with two ends, wherein a first of the two ends of the second section connects to the second end of the first section and an entirety of a region between the first end of the second section and a second of the two ends of the second section extends linearly downward from the second end of the first section to the second end of the second section.

10. The plate of claim 9, further comprising:
a plurality of holes about an apex at an intersection of the first section and the second section, wherein each of the plurality of holes extend down at least a sub-portion of each of the first and second sections, and the plurality of holes are separated from each other by material of the first and second sections.

11. The plate of claim 9, further comprising:
at least one material free region in both the first section and the second section of the lip, wherein the at least one material free region is in part below an apex at an intersection of the first section and the second section and above part of a cavity formed below the lip.

12. The plate of claim 9, wherein the second of the two ends of the second section is co-planar with the planar central region.

13. The plate of claim 12, wherein the first section has a first length, the second section has a second length, and the second length is greater than the first length.

14. The plate of claim 9, wherein the first section has a first length, the second section has a second length, and the first length is greater than the second length.

15. A plate for supporting a food product, comprising:
a planar central region with a perimeter, a top side, and a bottom side, which opposes the top side; and
a lip extending up from the top side, wherein the lip includes:
a first section with two ends, wherein a first of the two ends of the first section connects to the perimeter of the planar central region and an entirety of a region between the first of the two ends of the first section and a second of the two ends of the first section extends linearly upward from the top side at the perimeter to the second end of the first section, up and away from the planar central region; and a second section with two ends, wherein a first of the two ends of the second section connects to the second end of the first section and an entirety of a region between the first end of the second section and a second of the two ends of the second section curves inward with a decreasing slope from the second end of the first section to the second end of the second section, down and away from the planar central region.

16. The plate of claim 15, further comprising:

a plurality of holes about an apex at an intersection of the first section and the second section, wherein each of the plurality of holes extend down at least a sub-portion of each of the first and second sections, and the plurality of holes are separated from each other by material of the first and second sections.

17. The plate of claim 15, further comprising:

at least one material free region in both the first section and the second section of the lip, wherein the at least one material free region is in part below an apex at an intersection of the first section and the second section and above part of a cavity formed below the lip.

18. The plate of claim 15, wherein the second of the two ends of the second section is co-planar with the planar central region.

19. The plate of claim 15, wherein the first section has a first length, the second section has a second length, and the first length is greater than the second length.

20. The plate of claim 15, wherein the first section has a first length, the second section has a second length, and the second length is greater than the first length.

* * * * *